US005775606A

United States Patent [19]

Yang

[11] Patent Number: 5,775,606

[45] Date of Patent: Jul. 7, 1998

[54] COOLING ATTACHMENT FOR A GRINDER

[76] Inventor: Luyu Yang, 38 Westland Ave. #24, Boston, Mass. 02115

[21] Appl. No.: 632,056

[22] Filed: Apr. 15, 1996

[51] Int. Cl.[6] ..... B02C 23/18

[52] U.S. Cl. ..... 241/65

[58] Field of Search ..... 241/DIG. 37, 2, 241/65, 23, 66, 67

[56] References Cited

U.S. PATENT DOCUMENTS 5,431,348 7/1995 Orsolini et al. ..... 241/DIG. 37 X

FOREIGN PATENT DOCUMENTS 1546142 2/1990 U.S.S.R. ..... 241/DIG. 37

*Primary Examiner*—Mark Rosenbaum

[57] ABSTRACT

In essence, my design for cryogenic grinding and controlling the temperature of grinding makes use of liquid nitrogen, heated in thin-walled metal containers by the room temperature air. The nitrogen gas (or liquid) is conveyed by tubes to a cylinder cover fixed on top of the grinder's grinding chamber. The cover allows sufficient heat transfer and prevents producing static electricity by the spinning particles, and also prevents nitrogen from forming a liquid layer on the bottom of the cover. In my design: 1. The driving force of gas or liquid nitrogen is provided from the heat transferred between the liquid nitrogen in the containers and room temperature air, which creates pressure; 2. The temperature of grinding can be controlled by changing the flow rate of the room temperature air and by putting on or removing the rubber safety plug of one container; 3. Circulating the cold nitrogen by gas natural convection to cool down the motor allows continuous grinding. With Yang Cooling Attachment, the time needed to grind particles is reduced from a matter of days to matter of hours!

2 Claims, 6 Drawing Sheets

Prior Art

COOLING ATTACHMENT FOR A GRINDER

FIELD OF THE INVENTION

The invention is concerned with a cooling device for a micro-mill grinder as well as with the use of a micro-mill grinder for the cryocomminution of heat sensitive material.

BACKGROUND OF THE INVENTION

A micro-mill grinder of the conventional type includes a grinding chamber with a motor-driven blade in it; underneath the grinding chamber is an enclosure chamber containing the power circuit, motor and a small fan. The motor produces heat while the grinder is operating, and the function of the fan is to circulate the room temperature air into the enclosure chamber through a small opening on the bottom of the grinder to cool down the motor. The way to operate the grinder is to put the material into the grinding chamber, put on the cover and turn the switch on. It is very convenient and efficient.

This type of grinder is available commercially. For example, Tekmar Company's A-10, M-20 micro-mill grinder; and Gilson Company's Lc-1 and Lc-2 micro-mill grinder. The rotational speed of the grinder rotor is about 20,000 rpm and is particularly well adapted for grinding quite a variety of inorganic materials (clay, sand, sugar, gypsum, limestone), plant material(cellulose fibers, fodder), or other synthetic materials such as plastics. The recovery of ground material is close to 100%.

In the case of heat sensitive materials being ground, whether they be natural or synthetic, this type of grinder reaches its limit rapidly. For example, when grinding biopolymers, water cooling method (as shown in FIG. 10, water comes in and out from the tubes (19) on the side of coolant chamber (14)) is usually adapted because its convenience and low cost. A example is, when grinding PLGA (poly-Lactic-Glycolic-Acid), a material widely used for medical research. After grinding for only a few seconds, the grinder must be turned off for a few minutes to allow the motor cool down. Otherwise, PLGA will be melt. Therefore, grinding biopolymers into particles is a very slow and tedious process. To solve the problem, Tekmar Company (manufacture of Model A-10, M-20 micro-mill grinder) developed a cooling attachment which is particularly designed for this type of grinder (shown in FIG. 8), and is commercially available. As shown in FIG. 8, the cooling attachment (21) is designed to be fit on the top of the grinder (20), the cover of the grinder is replaced with the attachment. The attachment itself is simply a one-liter-volume metal cylinder. Liquid nitrogen or liquefied gas will be stored in the attachment when the grinder is operating. The temperature in the grinding chamber can reach −160° C. But in numerous instances investigated, the commercial cooling attachment proved to be not practical. The reasons are: 1. Liquid nitrogen forms on the bottom of the attachment. This is because at atmosphere pressure, the temperature of liquid nitrogen in the attachment is −196° C., the temperature on the metal surface of the attachment also approaches −196° C., therefore, nitrogen gas in the grinding chamber forms a liquid layer on the bottom of the attachment. As a consequence, the particles in the grinder chamber will be stuck on the liquid nitrogen layer and can't be ground anymore. 2. There are no obstacles attached to the cover which protrude into the grinding chamber to slow down the speed of the particles inside the grinding chamber. Therefore, after turning on the grinder for just a few seconds, a high speed uniform turbulent air flow is created inside the grinding chamber causing the particles to be swept around the grinding chamber at high speed. This makes it very difficult for the grinding blade to break up the particles. Also, the high speed particles produce static electricity which makes the particles stick to the bottom of the cooling attachment. Furthermore, although the grinding chamber gets very cold, the motor still gets so hot that the grinder can't operate continuously.

OBJECT OF THE INVENTION

The invention proposes a solution which is new and particularly effective for overcoming the problem described above.

The invention allows the grinding chamber to operate in the controlled temperature range between −20° C. and −140° C.; the grinder need not be turned off every seconds; and most of the static electricity in the grinding chamber is eliminated, allowing particles to settle back down to grinding chamber and be ground continuously and efficiently.

DETAILED DESCRIPTION OF THE INVENTION

Figure 1:
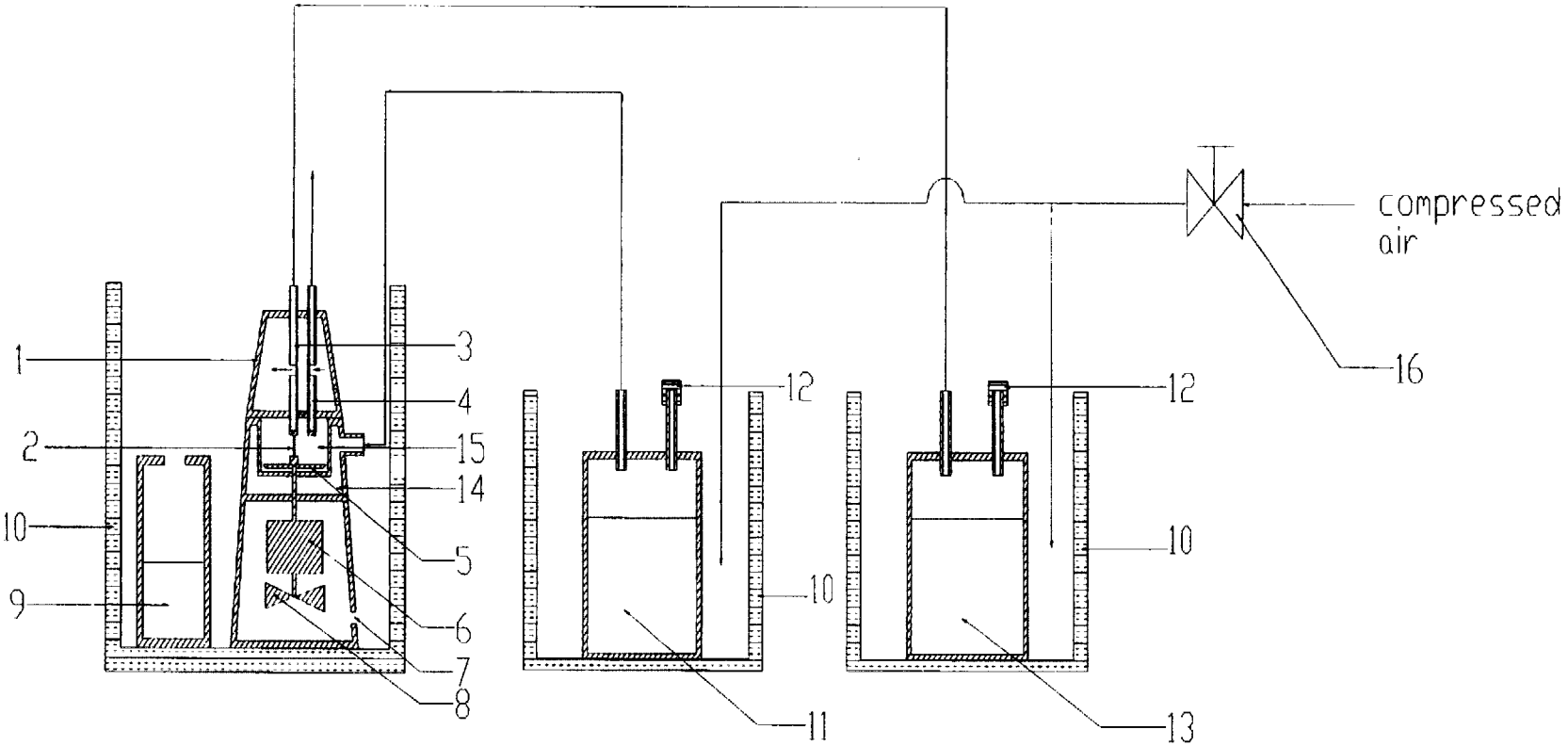
FIG. 1 is a diagrammatic cross-sectional view of design 1 of the invention. In this figure, the relative dimensions of each part of the system are not respected.

In one embodiment of the invention, the cooling attachment includes 3 thin walled metal tanks (9,11,13); 3 insulation boxes (10); a grinder cover (1) designed to be fit on the micro-mill grinder and a needle valve(16).

According to the invention, the process to achieve the continuous cryogenic-grinding is: In design 1, compressed air flows through the needle valve and is introduced into the insulation box. The room temperature air heats up liquid nitrogen tank 11 and tank 13. The liquid nitrogen inside the tanks are boiled and turn into cold nitrogen gas. As a consequence, the pressure inside the tanks is some value above the atmosphere pressure, and the cold nitrogen gas is forced out of the tanks and led by the tubes to cool the objects. Gas from tank 11 is led to coolant chamber (14) and cools the metal wall surrounding the grinding chamber. Gas from tank 13 is led to the grinder cover to cool the metal wall on the top of the grinding chamber and the fins (2), and tubes (3,4) which protrude into the grinding chamber. Although the cold gas does not directly contact the material inside the grinding chamber, the heat transfer takes place through the metal wall surrounding the grinding chamber, fins (2) and tubes (3,4). The material inside the grinding chamber is quickly cooled to very low temperature, especially when the grinder is operating. The blade (5) creates a very strong turbulent flow inside the grinding chamber. Therefore, the heat transfer coefficient between the air inside the grinding chamber, fins (2), tubes (3,4), and the wall around the grinding chamber is very high. Since the heat capacity of heat sensitive material is very small, the temperature of air inside the grinding chamber is very close to that of the material.

The setup of tank 11 and tank 13 alone is not efficient enough to operate the grinder continuously. The reason is that the motor (6) produces a lot of heat while the grinder is operating. Although the fan (8) circulates the room temperature air through the opening (7) to cool the motor (6), the air is not cold enough to take away the heat efficiently or keep the grinder cool. The motor produces so much heat that the grinder becomes overheated in a very short term of operation and has to be turned off. Moreover, the heat produced by the motor conducts to the grinding chamber through the metal and eventually the material inside the grinding chamber heats up. To overcome the problem, another liquid nitrogen tank 9 is designed to be setup next to the micro-mill grinder in the same insulation box (10). Then the hot gas circulated out of grinder heats up the tank 9, and turns liquid nitrogen into nitrogen gas which comes out from the tank 9, due to natural convection. Cold nitrogen gas stays on the bottom of the insulation box (10), and the hot gas circulated out of the grinder rises out of the insulation box (10). Therefore, the cold gas is circulated into the grinder through the opening (7) by the fan (8) to cool the motor (6). The whole grinder remains very cold and can continuously operate.

Figure 5:
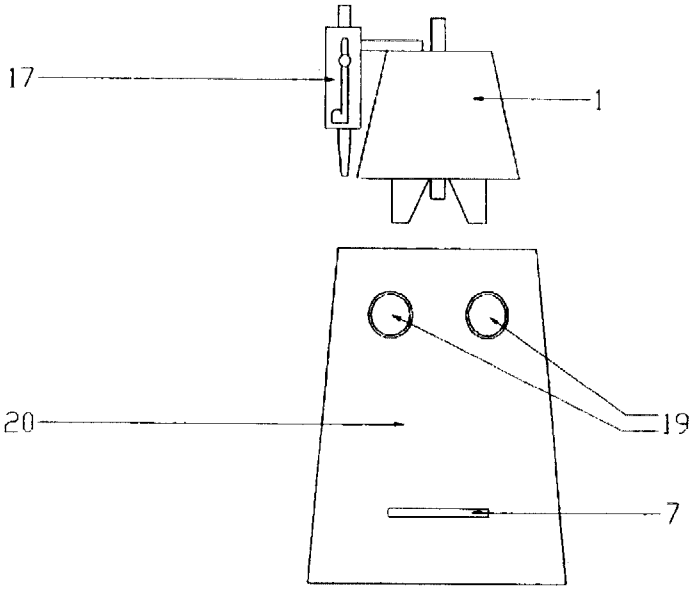
FIG. 5 is a diagrammatic view of Yang cooling attachment cover in design 1 designed to be fitted on the micro-mill grinder.
Figure 10:
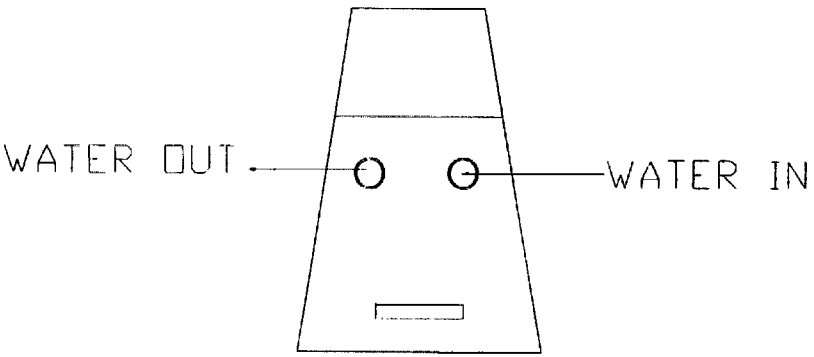
FIGURE 10 Prior Art
FIG. 10 is a view of water cooling method which is widely used on the micro-mill grinder. Prior Art.
Figure 9:
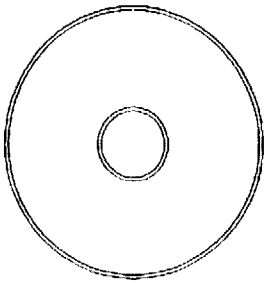
FIGURE 9 Prior Art
FIG. 9 is a top view of a commercial cooling attachment. Prior Art.
Figure 8:
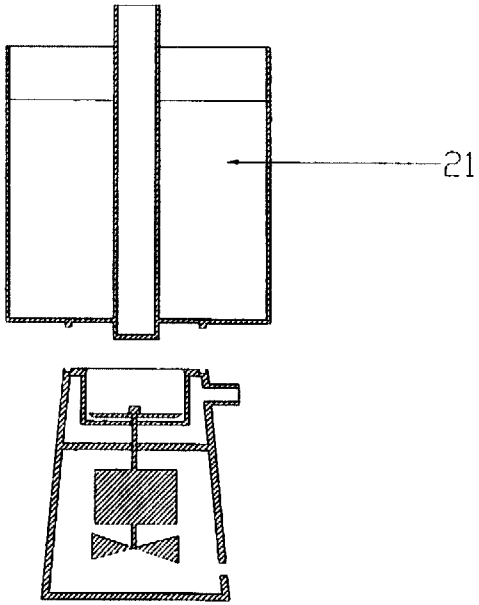
FIG. 8 is a diagrammatic cross-sectional view of a commercial cooling attachment fit on a micro-mill grinder. Prior Art.

As can be seen in FIG. 5, the Yang cooling attachment cover is designed to be fit on top of the micro-mill grinder. The safety switch (17) is shown in this figure. This switch is modified from the safety switch on the original cover of Tekmar Company grinder, and the safety switch can also serve as an on- off switch. The fins (2) and tubes (3,4) are designed to be the obstacles of the movement of the particles which are swept around the chamber in the turbulent air flow created by the spinning blade. The particles are bounced back by the fins and tubes and move in opposite direction with spinning blades, therefore, efficient grinding is achieved, and most of the static electricity is eliminated since the speed of the particles is slowed down by the fins and tubes. Most of the particles settle back down in the grinding chamber instead of being stuck on the wall by the static electricity which is caused by the high speed of the particles. The fins and tubes in design 1 provide an efficient heat transfer area as well.

Figure 2:
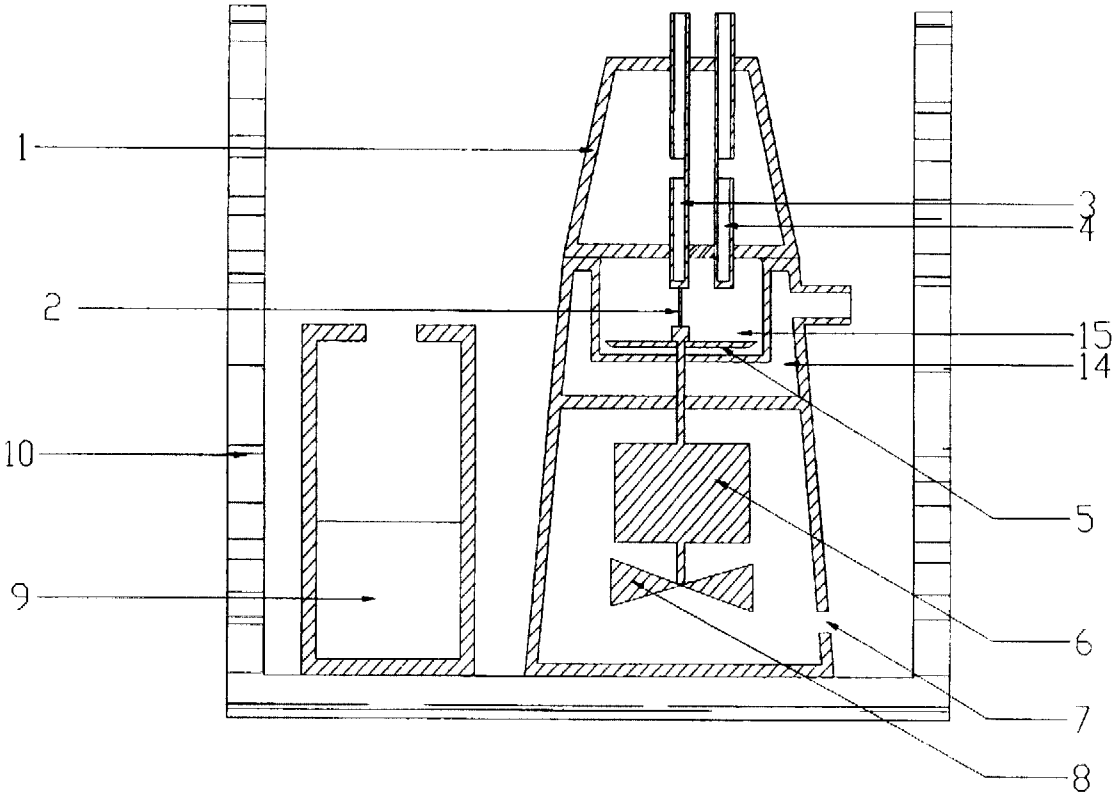
FIG. 2 is a more detailed diagrammatic cross-sectional view of the setup of cooling attachment cover, liquid nitrogen tank 9, and micro-mill grinder in design 1.
Figure 3:
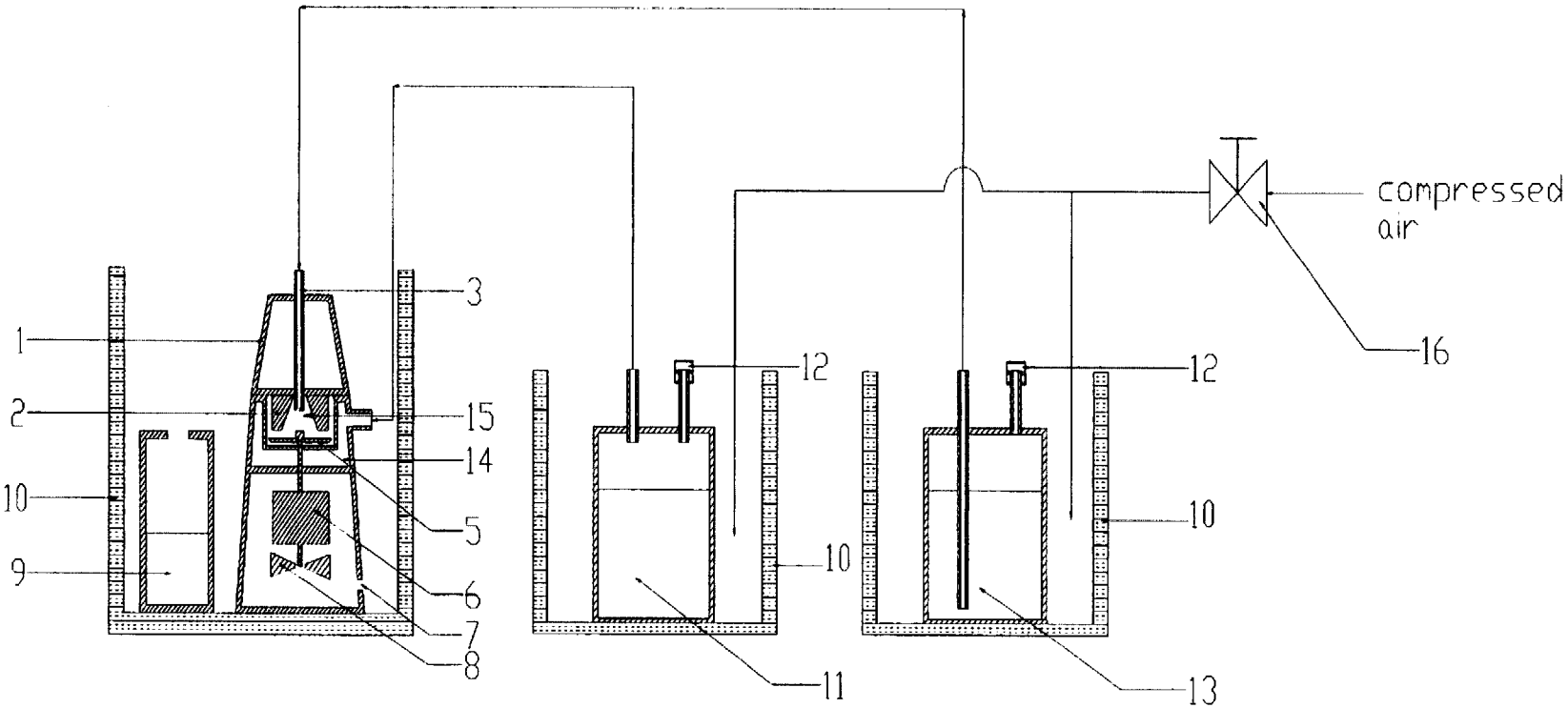
FIG. 3 is a cross-sectional view of an alternative to design 1, called design 2.
Figure 4:
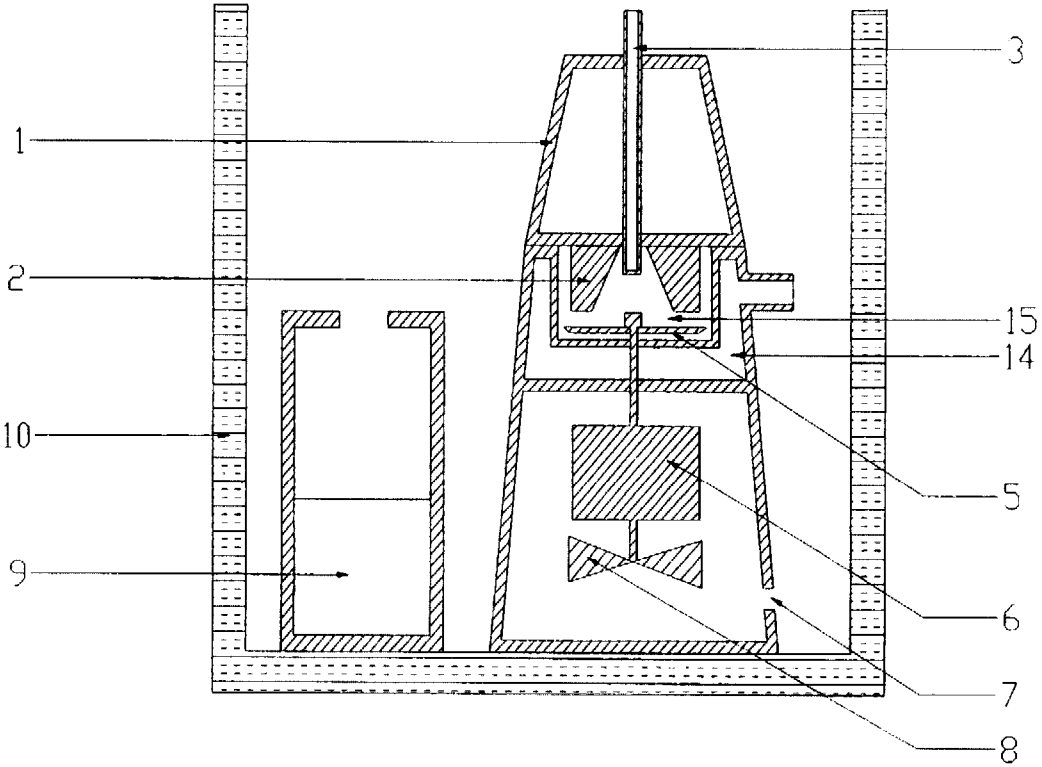
FIG. 4 is another more detailed diagrammatic cross-sectional view of the setup of cooling attachment cover, liquid nitrogen tank 9 and micro-mill grinder with various viewing angles of grinder cover (1), as also shown in design 2.
Figure 6:
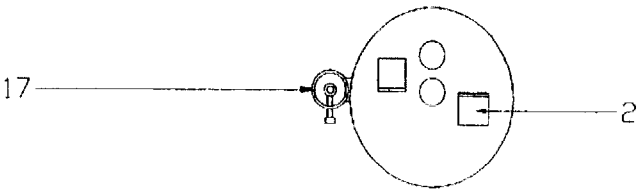
FIG. 6 is a bottom view of Yang Cooling Attachment cover in design 1.
Figure 7:
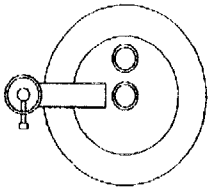
FIG. 7 is a top view of Yang Cooling Attachment cover in design 1 and 2.

FIG. 2 shows a cross-sectional view of design 2, which is an alternative to design 1. As can be seen in FIG. 2, the exit tube of liquid nitrogen tank 11 protrudes into the liquid nitrogen. Therefore, due to pressure, the liquid nitrogen is forced into the cover (1). Liquid nitrogen is boiled in the cover due to the heat transfer and turns into gas and exits from the exit tube (4) of the cover (1). The operating temperature (−140° C.) in the grinding chamber is much lower compared to design 1(−60° C.). In this design, if there is too much liquid nitrogen flowing into the cover and exiting from the exit tube (4), the flow of liquid nitrogen can be stopped by either closing the needle valve (16) or by removing the rubber safety plug (12) from tank 11. The rubber safety plug is designed to control the pressure inside the tank in a low value. When the pressure inside the tanks is built up and exceeds the weight of the rubber plugs (12), the rubber plugs are pushed up, and gas flow (design 1 or liquefied gas flow in design 2) stops. The relief pressure of the plugs (12) is about 10 inches water above atmosphere pressure.

Design 1 is very convenient to use since the cooling process is automatic, but the grinding chamber's operating temperature is not so low (can be controlled in range of between −20° C. and −60° C.). The temperature is sufficient for grinding biopolymers, but for grinding some tougher material like rubber or muscle tissue the temperature is not low enough to make the rubber or muscle tissue become very brittle and easy to be break. In that case, design 2 will be considered.

Design 2 is efficient for controlling the grinding temperature by removing or putting on the rubber safety plug (12) on tank 11, though it needs to be manually operated. One problem to be considered is that the grinder cover can't be filled with liquid nitrogen all the time. If it is, the nitrogen air in the grinding chamber forms into liquid nitrogen, and particles inside the grinding chamber get stuck on the bottom of the cover and can't be ground any more.

Note that the temperature in the grinding chamber is controlled by the flow rate of the compressed air. If the flow rate of air increases, the heat transfer rate between the liquid nitrogen and air is increased, causing more liquid nitrogen to be turned into gas phase. Therefore, the pressure inside the tank increases, more cold nitrogen gas in design 1 or more liquid nitrogen is design 2 is forced into the cover, and as a consequence the grinding temperature decreases.

EXAMPLES

Below is a chart comparing the results of three cooling methods including: water cooling, Tekmar Company cooling attachment and Yang cooling attachment. Material to be comminuted: copolymer of lactic and of glycolic acids or PLGA (molar ratio: 75:25).

The data for the Tekmar cooling attachment is not available except for the grinding temperature. This is because most of the particles aren't ground up since they are stuck to the bottom of the attachment after the grinder operates for a few seconds. By using Yang cooling attachment, it takes less than 2 hours to get 90% of particles less than 45 μm in size. The amount of liquid nitrogen used in this experiment was about 15 liters, which costs $3.75 (25 cents per liter).

| method | grinding chamber temperature (°C.) | weight of PLGA (grams) | work time | resulting particle size (<45 μm, w/w) |
|---|---|---|---|---|
| water-cooling | 10 | 1.4 | 3 days | 30% |
| Tekmar cooling attachment | −160 | N/A | N/A | N/A |
| Yang cooling attachment | −20 to −140 | 1.3 | 1.7 hr. | >90% |

I claim:

1. Apparatus for grinding heat sensitive material in a micro-mill grinder comprising: a micro-mill grinder having a grinding chamber and motor (6); thin-walled metal tanks (11,13) for storing liquefied gas, said tanks and said grinder being insulated by respective insulation boxes (10); a needle valve (16) for controlling the flow rate of room temperature air introduced into said insulation boxes in order to heat said tanks; rubber safety plugs (12) associated with said tanks to allow the operating pressure inside of said tanks to be at a relatively low value; a grinder cover (1) located above the grinding chamber, said cover including a fin and tubes extending into the grinder chamber to slow down the speed of the heat sensitive material while it is being ground in order to eliminate static electricity as well as provide a sufficient heat transfer area to cool down the material inside the grinding chamber; a liquefied gas tank (9) located adjacent said grinder within said grinder insulation box for cooling said motor so as to allow the grinder to operate continuously at a controlled grinding temperature.

2. Apparatus for grinding heat sensitive material in a micro-mill grinder according to claim 1, further comprising: an exit tube having one end extending into one of said thin-walled metal tanks while its other end is connected to the grinder cover to allow the introduction of liquefied gas directly into the grinder cover.

* * * * *